US006078140A

United States Patent [19]

Van Der Leeuw et al.

[11] Patent Number: 6,078,140

[45] Date of Patent: Jun. 20, 2000

[54] ELECTRIC LAMP HAVING SEALS WITH METAL FOIL THEREIN

[75] Inventors: Bart Van Der Leeuw, deceased, late of Turnhout, Belgium; by Henricus J. Kunnen, legal representative, Valkenswaard, Netherlands

[73] Assignee: U.S. Philips Corporation, New York, N.Y.

[21] Appl. No.: 08/870,177

[22] Filed: Jun. 5, 1997

[30] Foreign Application Priority Data

Jun. 6, 1996 [EP] European Pat. Off. ..... 96201564

[51] Int. Cl.[7] ..... H01J 5/46

[52] U.S. Cl. ..... 313/623; 313/331; 313/43; 313/251; 313/249

[58] Field of Search ..... 313/623, 634, 313/331, 332, 318.01, 43, 567, 251, 252, 284, 243, 245, 246, 248, 249, 264, 267, 113, 115

[56] References Cited

U.S. PATENT DOCUMENTS 3,609,212 9/1971 Lewis et al. ..... 313/332
5,077,505 12/1991 Ekkelboom et al. ..... 313/623
5,159,239 10/1992 Ekkelboom et al. ..... 313/623

FOREIGN PATENT DOCUMENTS 1975290 12/1967 Germany .
489626 7/1938 United Kingdom .
512257 8/1939 United Kingdom .

*Primary Examiner*—Nimeshkumar D. Patel
*Assistant Examiner*—Joseph Williams
*Attorney, Agent, or Firm*—F. Brice Faller

[57] ABSTRACT

The electric lamp has a vacuumtight seal (4) on the longitudinal axis (2) of a glass lamp vessel (1). An internal (12) and an external conductor (13) each have an end (14) inside the seal (4) and extend through a common axial region (5) of the seal (4) in a spaced apart manner. Several metal foils (11) arranged in a flat plane of the seal (4) extend parallel one to the other, in a transversal direction thereof. They have knife-shaped transversal edges (15) and are welded to the internal (12) and the external (13) conductors. The current conductors (10) constituted by the foils (11), the internal (12) and the external (13) conductors are able to conduct rather high currents. The lamp, nevertheless, is of a simple, strong and reliable construction.

7 Claims, 1 Drawing Sheet

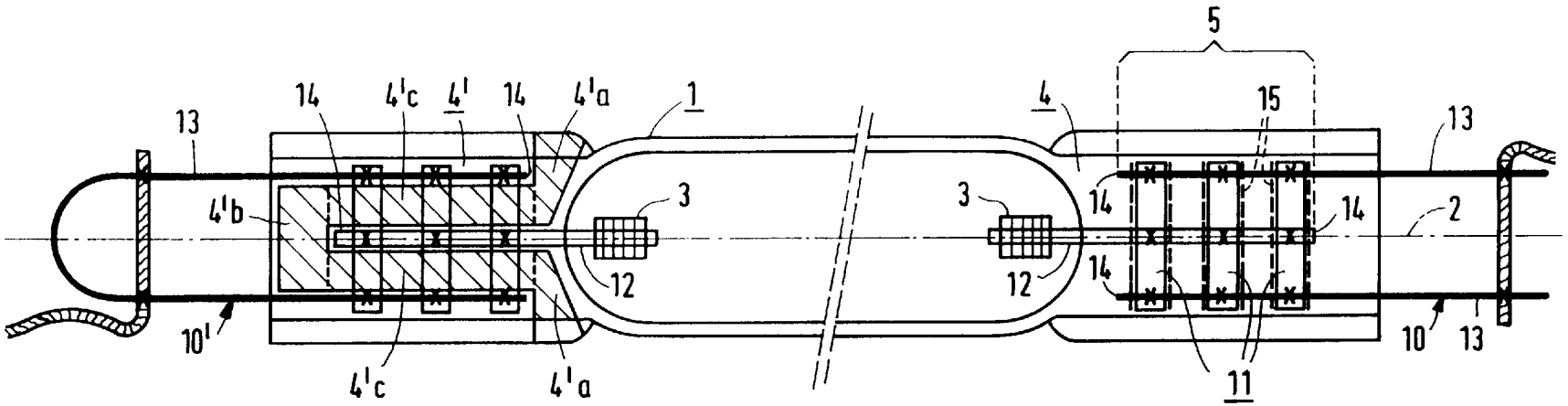
13
2
13
10
14
15
5
11
14
14
4
12
3
3
1
12
4'a
4'a
14
4'
4'c
4'c
14
4'b
13
10'

ELECTRIC LAMP HAVING SEALS WITH METAL FOIL THEREIN

BACKGROUND OF THE INVENTION

The invention relates to an electric lamp with a glass lamp vessel which is closed in a vacuumtight manner and which has a longitudinal axis;

current conductors extending from the exterior into the lamp vessel;

an electric element in the lamp vessel, connected to the current conductors, which lamp vessel has a seal on the longitudinal axis, through which seal at least one of the current conductors is passed, which at least one current conductor comprises a metal foil which is embedded in the seal and which lies substantially in a flat plane, an inner conductor being welded to said metal foil, extending into the lamp vessel and connected to the electric element, and an outer conductor being welded to said metal foil and issuing from the seal to the exterior, while the inner and the outer conductors each have an end within the seal, and on the metal foil (i) lie at a distance from one another seen in a direction transverse to the longitudinal axis and (ii) pass through one and the same axial zone of the seal.

Such a seal with such a current conductor passed through it is known from GB-B-512,257.

Current conductors comprising metal foils are widely used in seals when the glass of the seal has a coefficient of thermal expansion which is lower than the corresponding coefficient of the metal. This is the case if the glass must have a high softening temperature in view of the operational conditions of the lamp, while the metal for the same reason, and because of the high manufacturing temperature of the seal, must have a high melting point, such as tungsten and molybdenum.

The use of a metal foil means that the difference in coefficient of expansion between metal and glass, for example hard glass or glass having a $SiO_2$ content of at least 95% by weight, such as, for example, quartz glass, does not detract from the vacuumtightness of the seal. A condition for this is, however, that the axial edges of the metal foil are sharp, i.e. the foil has axial knife edges (also called feathered edges).

An electric lamp having seals in which such foils with etched axial edges are enclosed is known, for example, from U.S. Pat. No. 4,851,733. Such seals are interesting because they can be manufactured quickly in a portion of a lamp vessel which is still tubular in that this portion is heated to the softening point and is flattened with pinching blocks for obtaining a pinch seal. It is true that metal wires can also be enclosed in glasses of a lower coefficient of expansion in a vacuumtight manner, as is known from U.S. Pat. No. 5,077,505 and U.S. Pat. No. 5,159,239, but in that case the wire must have previously been coated with a glass layer which must be fused to the glass of the seal circumferentially.

Such wires having glass layers have the advantage when used as current conductors that they can carry comparatively strong currents owing to their comparatively great cross-sectional areas, in contrast to metal foils. Pinch seals with metal foils, on the other hand, can be realized more quickly.

Metal foils can be enclosed in seals in a vacuumtight manner in spite of the differences in coefficient of thermal expansion provided they are comparatively thin, have a comparatively great width/thickness ratio, and have sharp axial edges. The sharp axial edges are necessary for achieving that the glass, which is comparatively viscous during making of the seal, comes into contact with the foil circumferentially the axis. Without sharp axial edges, a capillary channel would be formed along the axial edges of the foil, which always occurs along the transverse edges and around the inner and the outer conductor, which would mean that the lamp vessel is leaky right from the start.

To make the current density in a metal foil as small as possible, the foil may be given the greatest possible transverse dimension, but wide foils can reduce the resistance to pressure of the lamp vessel because the adhesion between glass and metal is usually smaller than the adhesion between glass and glass. In the electric lamp of DE-G-1 975 290, comparatively wide metal foils having knife edges along their axial sides, with several inner conductors being welded to the one axial end, are provided with a pattern of perforations for this reason. The glass at the one side of the foils is fused to the glass at the other side through the holes in the foils. The mechanical strength and resistance to pressure of the seal are increased thereby.

The current density in the metal foil of the lamp according to the cited DE-G is comparatively small for a given current owing to the width of the foil, and the current is passed into and from the foil over the entire width thereof owing to the plurality of inner and outer conductors, but the current path through the foil, which runs in axial lamp direction, is comparatively long, so that the foil still has a comparatively high resistance.

In the electric lamp of GB-A-489,626, several metal foils are arranged next to one another in a flat plane in an axial zone of each seal. This leads to a mechanically strong seal because the glass is fused on either side of the foils, but at the same time the current density in the foils is greater than if one foil were to occupy the width now occupied by the foils as shown in the drawing. In addition, the current path running in axial direction trough the foils is comparatively long.

In the seal described in the opening paragraph and conforming to the cited GB-B-512,257, both the outer and the inner conductor pass through substantially the entire length of the metal foil, at mutually opposed sides thereof, so that they overlap one another at a distance over an axial longitudinal portion of the seal. The current paths as a result run through the foil transversely to the longitudinal direction of the foil. A favorable aspect of this geometry is that there is a short and wide current path through the foil, so that the resistance of and the current density in the foil are comparatively small. A major disadvantage, however, is that this geometry is highly critical and involves a major risk of a leaky seal.

Metal foils are made in that pieces are cut off from a length of tape having sharp lateral edges. The cut edges are accordingly not feathered and sharp. The glass of the seal does not merge closely around the cut edges but leaves a capillary channel open which extends transversely along the foil in the seal. The inner or outer conductor runs over the relevant cut edge onto the foil. A capillary channel extends around the inner and around the external conductor to outside the seal because these conductors have a comparatively great thickness of several, for example, 7 or more tenths of a millimeter (in contrast to metal foils in seals which usually have a thickness of 10 to 120 $\mu$m), and because they shrink more strongly than the surrounding glass after the seal has been made. These channels do not end until beyond the ends of the relevant conductors situated inside the seal.

The geometry of this construction involves the major risk that one or several of the capillary axial channels around the current conductors are in open connection with the two capillary transverse channels along the cut edges of the metal foil. The seal leaks in that case. It is in addition unfavorable that the conductors are welded along the axial, sharp edges of the foil where the foil is thin and a weld accordingly is mechanically very weak, which strongly limits the handling possibilities of the current conductor during lamp assembly. Another disadvantage is that the conductors are welded on either side of the metal foil in the known current conductor. This complicates the manufacture of the current conductor.

The seal shown in the cited GB-B-512,257, in which the inner conductor, the metal foil, and the outer conductor are stacked in an axial plane transverse to the seal, is of no use because it involves a very great risk of leaks. When welded joints are made between these metal parts, indeed, a hole may readily arise in the metal foil, affording access to either of the capillary channels around the two conductors owing to the geometry.

SUMMARY OF THE INVENTION

It is an object of the invention to provide an electric lamp of a simple and reliable construction.

According to the invention, at least two metal foils axially spaced apart are transversely accommodated in the seal, which foils have knife edges at their transverse sides, and the conductors are each connected to each foil.

The seal of the electric lamp according to the invention has several metal foils in the current conductor. The outer conductor conducts current into each of the foils, and the inner conductor drains off this current. The foils each pass a proportional part of the current through the current conductor, so that the current density in said foils is low, as is the heat generation therein. Conventional foils of conventional width can be used for conducting strong currents through the seal. In contrast to the seal according to the cited GB-B-512,257, the foils conduct the current in their longitudinal direction, which means that the cross-sectional areas of the foils transverse to the direction of the current are constant or substantially constant, unlike in the known current conductor.

The seal is mechanically strong and accordingly resistant to comparatively high pressures in the lamp vessel because the glass is solid in axial zones between the foils, and is not laminated with foils there.

The construction of the seal is not very critical, as will be explained further below also with reference to the drawing. The conductors are allowed to end each beyond the foil lying farthest away from the relevant conductor, provided they end inside the seal, without the vacuumtightness of the seal being jeopardized. They may then be, but need not be welded close to the axial edges, the cut edges, of the foils. The conductors may in fact be welded to the foils in locations in a central region, at a distance from the transverse knife edges of the foils, where the latter are comparatively thick. The current conductor is mechanically comparatively strong as a result and can be easily handled.

The transverse space between the inner and the outer conductor need only be so small, for example a few millimeters, that a vacuumtight transverse zone is certain to be present between these conductors and to extend over the foils. A transverse space will be available in the seal of many types of lamps for giving the inner and/or outer conductor a multiple construction. It is often advantageous for simplicity of lamp construction to provide a multiple outer conductor, for example a double conductor. The inner conductor is then positioned between the portions of the outer conductor, whereby the current density in the foils is halved.

The lamp may have a second seal opposite the seal discussed above, through which the second current conductor enters. This second current conductor may be, for example, a wire coated with a glass layer. Alternatively, the construction of the second seal may be the same as that of the first. The seal is so wide in some lamps that a second current conductor of the same kind is accommodated in said first seal.

It is an advantage of the lamp according to the invention that the inner and the outer current conductors are allowed to be placed at the same side or at different sides of the metal foils without the lamp quality being influenced thereby. This is favorable because it offers the possibility of positioning the conductors at one and the same side of the foils, which is convenient for the manufacture of the current conductor, which can now be manufactured in a short time.

The number of foils to be placed side by side may be chosen in dependence on the current to be passed through the lamp; in general, no more than approximately 10 A will preferably be passed in one current path through one foil, and preferably less.

The electric element of the lamp according to the invention may be a pair of electrodes in an ionizable medium, such as, for example, tungsten electrodes in a rare gas, possibly with metal halide and/or mercury. Alternatively, the electric element may be an incandescent body, for example in an inert gas, for example an inert gas with a halogen or halogen compound such as, for example, hydrogen bromide. The electric element may be enclosed in an inner envelope. Tungsten is often chosen for the inner conductor, for example because of its chemical resistance, while molybdenum is often preferred for the metal foil and the outer conductor, for example because of the ductility of this metal. The electric lamp may have one or two lamp caps, as desired.

BRIEF DESCRIPTION OF THE DRAWINGS

An embodiment of the electric lamp according to the invention is shown in side elevation in the drawing.

DETAILED DESCRIPTION OF PREFERRED EMBODIMENTS

In the FIGURE, the electric lamp has a glass lamp vessel 1, made of quartz glass in the FIGURE, which is closed in a vacuumtight manner and has a longitudinal axis 2. Current conductors 10, 10' extend from the exterior into the lamp vessel 1. An electric element 3, a pair of tungsten electrodes in an ionizable gas such as, for example, mercury, rare gas, and metal halide in the FIGURE, is positioned inside the lamp vessel and is connected to the current conductors 10, 10'. The lamp vessel 1 has a seal 4 on the longitudinal axis 2, through which seal at least one of the current conductors 10, 10' is passed. This current conductor 10 comprises a metal foil 11 which is situated substantially in a flat plane and is embedded in the seal 4. An inner conductor 12 is welded to this metal foil 11, made of molybdenum in the Figure, this inner conductor being made of tungsten in the Figure, extending into the lamp vessel 1, and being connected to the electric element 3, and an outer conductor 13 of molybdenum in the Figure and issuing from the seal 4 to the exterior is also welded to the foil. The inner 12 and outer conductor 13 each have an end 14 inside the seal 4. On the metal foil 11 (i) they lie at a distance from one another seen in a direction transverse to the longitudinal axis 2 and (ii) they traverse one and the same axial zone 5 of the seal 4.

At least to metal foils 11, in the FIGURE three, are transversely enclosed in the seal 4, axially spaced apart from one another having knife edges at transverse sides 15 thereof, for example obtained through etching. The conductors 12, 13 are each connected to each of the foils 11.

The outer 13 and the inner conductor 12 are welded to the metal foils 11 at a distance from the transverse edges 15 thereof. The welding spots have been indicated with crosses.

A conductor 12, 13 chosen from the inner conductor 12 and the outer conductor 13 is of multiple construction, in the FIGURE this is the outer conductor 13.

The inner conductor 12 is placed so that it is flanked on either side by the outer conductor 13. This has the advantage that the electrode 3 can be easily given a central position without a complicated construction inside the lamp, while the outer conductor 13 can be readily supplied to the manufacturing process in the form of a hairpin, and even may have retained this hairpin shape.

A second seal 4', in which a current conductor 10' of the same geometry as in the seal 4 is present and which is also obtained by pinching, lies opposite the seal 4.

The inner 12 and outer conductor 13 are welded to a same side of the metal foils 11, which facilitates the manufacture of the current conductor 10 and accordingly of the lamp.

In the Figure, the portion forming a vacuumtight barrier between the discharge space and the surroundings of the lamp is shown hatched in the seal 4'. A capillary space extends both along the outer conductor 13 and along the inner conductor 12 from the exterior and from the discharge space, respectively, to just beyond the relevant end 14 in the seal 4'. Regions 4'*a* and 4'*b* of the seal 4' lying in the extended directions of the outer 13 and inner conductor 12, however, are vacuumtight. Regions 4'*c* merging into the regions 4'*a* and 4'*b* are vacuumtight both at the areas of and next to and between the metal foils 11 thanks to the transverse knife edges 15 thereof. As a result, the seal 4' is vacuumtight over its entire width. It is evident from the Figure that the construction of the seals 4, 4', and thus of the lamp, is not critical. It is immaterial whether the ends 14 of the inner 12 and the outer conductor 13 lie on or beyond a metal foil 11. Neither is it of any importance for the vacuumtightness of the seal whether or not holes have been made in the metal foils during welding.

The lamp of the type shown consumes a power of approximately 4000 to approximately 6000 W at a current of, for example, approximately 20–30 A during stable operation. The current traverses the seal 4 from the outer 13 to the inner conductor 12 in its transverse direction, but at the same time in the longitudinal direction of the metal foils 11, parallel to the transverse knife edges 15 thereof. Six electrically parallel current paths of at least substantially the same electrical resistance are present between the inner 12 and the outer conductor 13 in the lamp shown, so that the current density in each of the metal foils 11 amounts to approximately one sixth of the current density in the metal foil of a conventional lamp.

The construction of the lamp is simple, can be obtained in a simple manner, is effective, and not very critical, and is in addition mechanically strong.

I claim:

1. An electric lamp comprising a glass lamp vessel which is closed in a vacuum tight manner, said lamp vessel having a longitudinal axis, and a seal on said axis, an outer conductor extending from outside said lamp into said seal and having an end within said seal, an inner conductor extending from inside said lamp into said seal and having an end within said seal, said inner conductor being spaced apart from said outer conductor transversely of said axis in an axial zone extending along said axis, and at least two metal foils embedded in said seal in said axial zone, each said foil extending transversely of said axis and being welded to said inner conductor and to said outer conductor.

2. An electric lamp as in claim 1 wherein said metal foils each have a pair of opposed knife edges extending transversely of said axis.

3. An electric lamp as in claim 1 wherein each said foil has a pair of transverse edges extending transversely of said axis, said inner and outer conductors being welded to said foils between said transverse edges.

4. An electric lamp as in claim 1 comprising two said outer conductors extending into said seal, said at least two metal foils being welded to said inner conductor and both of said outer conductors.

5. An electric lamp as in claim 1 comprising a pair of said seals on said axis, a pair of said outer conductors extending into respective said seals from outside the lamp vessel, a pair of said inner conductors extending into respective said seals from inside the lamp vessel, and at least two said metal foils in each said seal.

6. An electric lamp as in claim 1 wherein each foil has a pair of opposed planar surfaces, said inner and outer conductors each being welded to the same planar surface of each said foil.

7. An electric lamp as in claim 1 further comprising an electric lamp element connected to the inner conductor in said lamp vessel.

* * * * *